US005650786A

United States Patent [19]

Aubry et al.

[11] Patent Number: 5,650,786

[45] Date of Patent: Jul. 22, 1997

[54] COMPENSATION DEVICE FOR AIMING ERRORS CAUSED BY THE MALFUNCTIONING OF ELECTRONIC SCANNING ANTENNA PHASE-SHIFTERS OR BY THE MALFUNCTIONING OF COEFFICIENTS OF ANTENNAS WITH BEAM-SHAPING BY COMPUTATION

[75] Inventors: Claude Aubry, Grigny; André Peyrat, Montrouge, both of France

[73] Assignee: Thomson-CSF, Paris, France

[21] Appl. No.: 376,886

[22] Filed: Jan. 20, 1995

[30] Foreign Application Priority Data

Jan. 21, 1994 [FR] France ..... 94 00635

[51] Int. Cl.[6] ..... H01Q 3/22

[52] U.S. Cl. ..... 342/371; 342/372

[58] Field of Search ..... 342/371, 372, 342/173, 174, 374

[56] References Cited

U.S. PATENT DOCUMENTS

| | | | |
|---|---|---|---|
| 3,747,098 | 7/1973 | Kirkpatrick et al. | 342/371 |
| 3,797,020 | 3/1974 | Roger et al. . | |
| 3,984,788 | 10/1976 | Peyrat . | |
| 4,005,361 | 1/1977 | Lerner | 340/658 |
| 4,176,354 | 11/1979 | Hsiao et al. | 342/173 |
| 4,191,960 | 3/1980 | Lopez | 342/377 |
| 4,260,993 | 4/1981 | Aubry et al. . | |
| 4,649,393 | 3/1987 | Rittenbach . | |
| 4,665,405 | 5/1987 | Drabowitch et al. . | |
| 4,672,378 | 6/1987 | Drabowitch et al. . | |
| 4,697,141 | 9/1987 | Feldman . | |
| 4,740,791 | 4/1988 | Darbowitch et al. . | |
| 4,792,811 | 12/1988 | Aubry et al. . | |
| 4,924,232 | 5/1990 | Hudson et al. | 342/174 |
| 4,926,186 | 5/1990 | Kelly et al. . | |
| 5,038,149 | 8/1991 | Aubry et al. . | |
| 5,053,777 | 10/1991 | Peyrat . | |
| 5,083,131 | 1/1992 | Julian . | |
| 5,138,324 | 8/1992 | Aubry et al. . | |
| 5,279,165 | 1/1994 | Bizot et al. . | |

FOREIGN PATENT DOCUMENTS

| | | |
|---|---|---|
| 0 367 167 A3 | 5/1990 | European Pat. Off. . |
| 24 42 185 | 3/1976 | Germany . |
| 29 04 095 | 8/1979 | Germany . |

OTHER PUBLICATIONS

English Abstract of Japanese Patent 60–51302, Mar. 22, 1985.

*Primary Examiner*—Gregory C. Issing

*Attorney, Agent, or Firm*—Oblon, Spivak, McClelland, Maier & Neustadt, P.C.

[57] ABSTRACT

Disclosed is a device to compensate for the aiming errors caused by malfunctions in phase-shifters of electronic scanning antennas. With the electronic scanning antenna being plane and having a power distribution that is symmetrical in amplitude and in phase, the device has means positioning a malfunctioning phase-shifter and its symmetrical phase-shifter in supplementary phase states. Application notably to landing systems requiring high precision for the aiming of the beam in free space.

10 Claims, 3 Drawing Sheets

COMPENSATION DEVICE FOR AIMING ERRORS CAUSED BY THE MALFUNCTIONING OF ELECTRONIC SCANNING ANTENNA PHASE-SHIFTERS OR BY THE MALFUNCTIONING OF COEFFICIENTS OF ANTENNAS WITH BEAM-SHAPING BY COMPUTATION

BACKGROUND OF THE INVENTION

The present invention relates to a compensation device for aiming errors caused by the malfunctioning of phase-shifters of electronic scanning antennas or by the malfunctioning of coefficients of antennas with beam-shaping by computation.

It can be applied notably to electronic scanning antennas when one or more electronically controlled phase-shifters used in the antenna to deflect its beam are malfunctioning, these malfunctions causing a deterioration of the precision of aim in free space of the beam.

In an electronic scanning antenna, the aiming of a beam at a given instant towards a given direction of space is done by acting on the radiation phase of the radiating sources called elementary sources forming the antenna. In order that the changes in the aiming direction may be swift, the modification of the phase of the elementary sources is obtained by the insertion of the electronically controlled phase-shifters series-connected between a microwave power distributor and the elementary sources. A phase-shifter may serve several elementary sources, but the most usually adopted approach is to provide one phase-shifter for each elementary source.

The electronic control of the phase-shifters is done in such a way that the radiated energy gets focused at a great distance in a desired direction. This is done by positioning the different phase-shifters in a certain phase state that is determined a way known to those skilled in the art. Chapter 7 the second edition of Merril I. Skolnick, "Radar Handbook", Mac Grawhill, gives a extensive description of the techniques used and their applications to radar.

It has been shown and verified in practice that, provided that there is a sufficient number of elementary sources, it is not necessary to have a large number of phase states on the phase-shifters in order to obtain efficient performance. In practice, the phase-shifters are therefore controlled by digital data elements in the form of messages giving the phase to be displayed on N bits, which corresponds to $2^N$ phase positions theoretically spaced out every $360°/2^N$. The spacing thus corresponds to 45° in the example where N =3 or 22.5° in an example where N=4. Depending on the technology used for the phase-shifter, it is either economically desirable, notably in the case of diode-operated phase-shifters, or unimportant, notably in the case of ferrite phase-shifters, to reduce the number N of bits to the maximum extent, in practice, it is possible to limit the operation to N=1 to 4.

The malfunctions that affect the phase-shifters and the drop in performance resulting therefrom constitute a phenomenon that is accepted rather than resisted. Additional safety margins over what would be necessary for maintaining performance characteristics with all the phase-shifters in operating condition make it possible to cope with this problem. These safety margins are such that, with a given number of malfunctioning phase-shifters, whatever the distribution of these phase-shifters in the antenna, the requisite performance characteristics are always met.

The known methods used to compensate for the effect of malfunctions in phase-shifters therefore consists notably in designing the antenna so that it has performance characteristics which, when there is no malfunctioning in the phase-shifters, are far higher than necessary so that, when there is malfunctioning in the phase-shifters, the requisite performance characteristics are always obtained. The phase-shifters are monitored in order to ascertain, either constantly or at short intervals, that they are truly in working order. The number of suspect phase-shifters is updated and constantly monitored so as to warn the operator or the maintenance services when their number approaches or reaches the maximum number that the system can bear without falling below the requisite performance level. A maintenance operation is needed to replace the suspect phase-shifters.

In the particular case of the MLS system or microwave landing system relating to terminal guidance for landing in airports, using electronic scanning antennas and for which the aiming precision is a priority characteristic, a U.S. Pat. No. 4,041,501 describes a particular embodiment of an electronic scanning MLS antenna and another U.S. Pat. No. 4,359,740 describes the means to cancel the aiming error caused in such an antenna by the malfunctioning of a phase-shifter. The invention described in the latter patent can be applied to diode-operated phase-shifters using, as a 0°–180° cell, a 3 dB coupler connected to two switching diodes controlled independently of each other. As soon as a phase-shifter malfunction is detected, the two diodes of the 0°–180° cell are switched into two distinct states. One of them is then on and therefore in a state of low impedance which may be capacitive. The result is that the microwave signal that goes through the phase-shifter is then cut off or rather greatly attenuated. Consequently, it no longer plays a part in the radiation of the antenna and the aiming error of the beam in free space, resulting from the malfunctioning of the phase-shifter in question, is cancelled. This results directly from the fact that by creating an amplitude gap at the corresponding radiating element, which inhibits the effect of the phase errors, the antenna pattern is deformed symmetrically and the direction of maximum radiation remains unchanged.

These methods have several drawbacks. The methods make it necessary to provide for a margin in the required performance characteristics necessitating a costly design. The associated extra cost is directly related to the desired performance level and to the number of malfunctions that the system can accept. This excess cost may be considerable if the performance level required is high or if the number of malfunctions to be tolerated is great.

The method described in the U.S. Pat. No. 4,359,740 provides a solution only when the phase-shifter is a diode-based phase-shifter and uses a 0°–180° cell comprising two diodes working by reflection of the high frequency signal. Furthermore, it is ineffective when the high frequency signal cut-off device is itself out of order.

The aim of the invention is to overcome the above-mentioned drawbacks, notably by enabling the cancellation of the aiming error in free space due to one or more malfunctions of phase-shifters without its being necessary to complicate these phase-shifters.

SUMMARY OF THE INVENTION

To this end, an object of the invention is a device for the compensation of aiming errors caused by malfunctions of phase-shifters in a plane electronic scanning antenna having a power distribution that is symmetrical in amplitude, wherein said device comprises means positioning a malfunctioning phase-shifter and its symmetrical phase-shifter in supplementary phase states.

The main advantages of the invention are that it releases the designing of the antenna from the constraints of the effect of the malfunctions on the aiming precision, can be applied to all types of electronic phase-shifters, does not require the incorporation, in the phase-shifter, of means to prevent this phase-shifter from radiating when it is malfunctioning, enables flexibility of use and is simple to implement and economical.

BRIEF DESCRIPTION OF THE DRAWINGS

Other features and advantages of the invention shall appear from the following description made with reference to the appended figures of which.

MORE DETAILED DESCRIPTION

Figure 1:
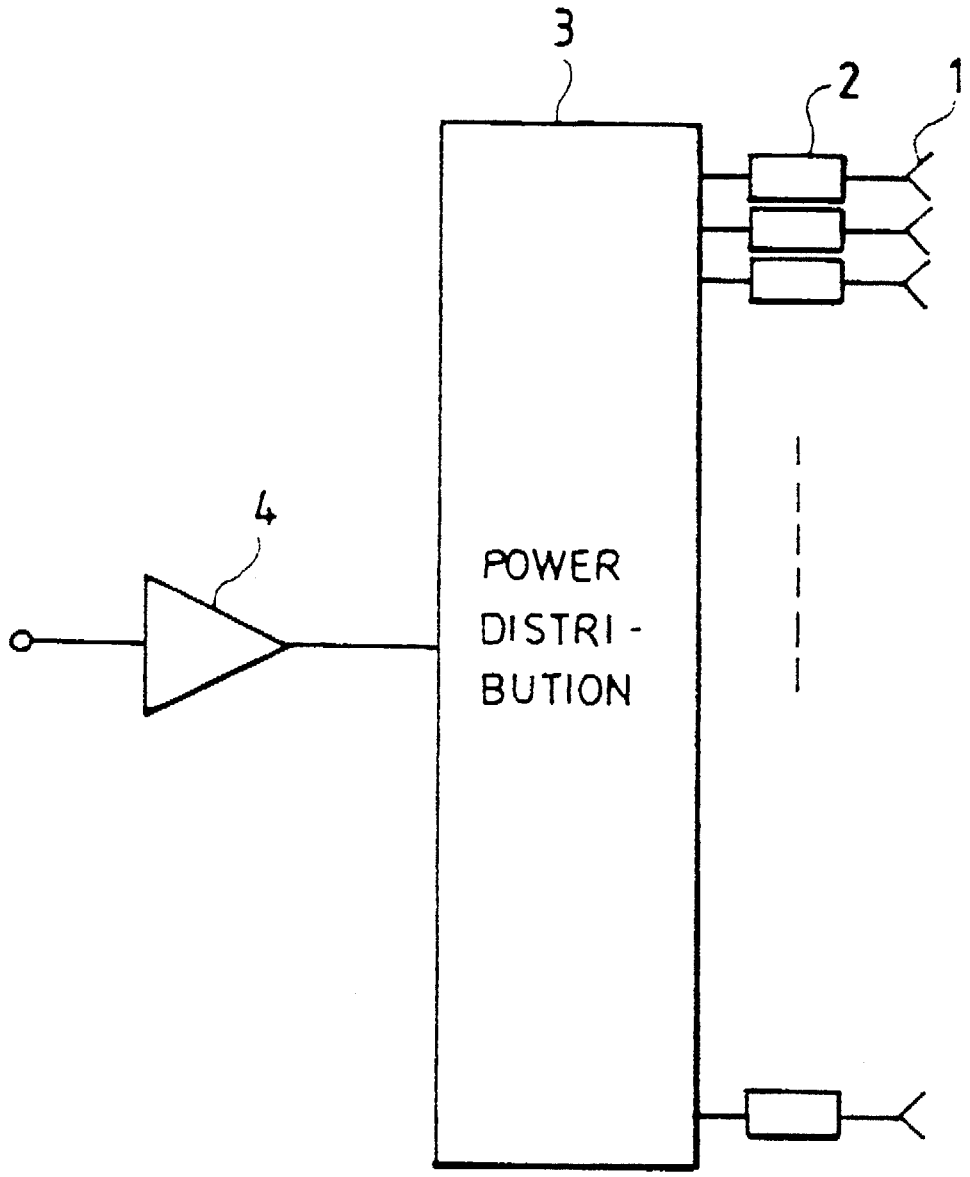
FIG. 1 shows the structure of a plane electronic scanning antenna.

FIG. 1 shows the structure of a plane electronic scanning antenna. It comprises elementary radiating sources 1. In order that the changes in aiming direction may be swift, the modification of the phase of the elementary sources 1 is obtained by means of electrically controlled phase-shifters 2, series-connected between a microwave power distributor 3 and the elementary sources 1. A phase-shifter 2 is, for example, associated with each elementary source 1. The input of the power distributor 3 is, for example, connected to the output of a power transmitter 4.

The principle of the invention makes use of a particular formulation of the aiming error which shows that there exist means to cancel the aiming error caused by the malfunction of a phase-shifter other than, for example, that of preventing it from radiating.

In a plane electronic scanning antenna, comprising N aligned sources, the amplitude of the resultant electrical field at great distance in the direction of the direction cosine $u_0$ is, when the antenna is positioned to be aimed in a direction of the direction cosine u, given in free space by the following relationship:

$$E_u(u_0) = \sum_{n=1}^{N} A_n e^{2\pi j \frac{x_n}{\lambda}(u-u_0)} e^{j\phi_n} \tag{1}$$

where n is the number of an elementary source, $A_n$ the amplitude of the signal that it radiates, $\lambda$ the wavelength in the air and $x_n$ its abscissa and where $\phi_n$ represents the phase error on the phase-shifter associated with the number n elementary source.

If the phase-shifter in question works properly, then $\phi_n=0$ barring errors relating to manufacture and quantification. The aiming direction is obtained by seeking the maximum radiation as the function of the direction cosine $u_0$, which is obtained by cancelling the derivative of the function $|E_u(u_0)|^2$, giving:

$$\frac{d|E_u(u_0)|^2}{du_0} = 0 \tag{2}$$

this cancellation being done for $u_0=u+\delta_u$ where $\delta_u$ represents the aiming error.

The computation of the aiming error $\delta_u$ is relatively complicated in general but gets considerably simplified under the following hypotheses which are achieved in most cases of practical application:

- the number of malfunctioning phase-shifters is smaller than the number of phase-shifters, smaller than 10% for example,
- the total number of phase-shifters implemented is great enough for the above hypothesis to have a meaning: this total number is, for example, greater than or equal to 20.

Once these hypotheses are taken into account, the result of the computation is an aiming error $\delta_u$ given by the following relationship:

$$\delta_u = -\frac{\lambda}{2\pi} \frac{\sum_{p\in P} A_p x_p \sin\phi_p}{\sum_{n=1}^{N} A_n x_n^2} \tag{3}$$

where P represents all the numbers of malfunctioning phase-shifters.

It appears clearly in this relationship that the phase-shifters that are not malfunctioning do not participate in the error $\delta_u$ and that this error gets cancelled whenever there is no phase-shifter malfunctioning.

The principle of the invention consists in cancelling the aiming error $\delta_u$ not by cancelling the amplitude $A_p$ but by cancelling the term in the numerator of the relationship (3), namely the term $$\sum_{p\in P} A_p x_p \sin\phi_p,$$

it being understood that the antenna has a symmetrical distribution, i.e. one wherein the elementary sources that are located symmetrically, except for the mechanical tolerance values, with respect to the center radiate with identical amplitudes and opposite phases, except for manufacturing errors.

For this antenna, it is then possible to reformulate the relationship (1) giving the field by the following relationships:

$$E_u(u_0) = \sum_{n=\frac{-(N-1)}{2}}^{+\frac{N-1}{2}} A_n e^{2\pi j \frac{x_n}{\lambda}(u-u_0)} e^{j\phi_n}$$

when N is an odd number (4) and $$E_u(u_0) = \sum_{n=-\frac{N}{2}}^{-1} A_n e^{2\pi j \frac{x_n}{\lambda}(u-u_0)} e^{j\phi_n} + \sum_{n=+1}^{+\frac{N}{2}} A_n e^{2\pi j \frac{x_n}{\lambda}(u-u_0)} e^{j\phi_n}$$

when N is an even number (4*a*)

If, furthermore, the origin of the abscissas is located at the center of symmetry, then each source having an abscissa value $x_n$ radiates a signal with an amplitude $A_n$ with, in order to aim towards the direction cosine u, a phase equal to $$2\pi \frac{x_n}{\lambda} u$$

and its symmetrical source, having an abscissa value $x_{-n}=-x_n$ radiates a signal with an amplitude $A_{-n}=A_n$ with an opposite phase:

$$2\pi\frac{x_{-n}}{\lambda}\ u=-2\pi\frac{x_n}{\lambda}\ u.$$

The device according to the invention includes means enabling it, as soon as the phase-shifter is malfunctioning, to place the symmetrical phase-shifter in a state that is always supplementary, to the nearest $2\pi$, to the state in which the malfunctioning phase-shifter is placed. Thus, if the malfunctioning phase-shifter is in a phase $\phi$ state, its symmetrical phase-shifter is positioned in the phase state $\pi-\phi$ or $3\pi-\phi$, or more generally $(2\ k+1)\pi-\phi$, k being a relative integer.

In a first possible embodiment, the malfunctioning phase-shifter is, for example, locked in a fixed phase state $\phi_0$ and kept in this state permanently. Its symmetrical phase-shifter is then locked in a supplementary phase state, $\pi-\phi_0$ or $3\pi-\phi_0$ for example and kept permanently in this phase state.

In a second possible embodiment, the phase states that have remained available on the malfunctioning phase-shifter continue, for example, to be exploited and the symmetrical phase-shifter is positioned at all times in the supplementary phase state.

The phase states of the two phase-shifters therefore vary with the beam of the antenna while at the same time remaining supplementary to within a value of $2\pi$.

The aiming errors resulting from the malfunctioning are thus cancelled, and this is done without resorting to any cancellation of the signal radiated by the malfunctioning phase-shifter. Indeed, the aiming error resulting from the malfunction of a phase-shifter supplying a source p is given by the following relationship:

$$\delta_{u_p}=-\frac{\lambda}{2\pi}\ \frac{A_p\,x_p\sin\phi_p}{\sum_{n=-N/2}^{N/2}A_n x_n^2} \tag{5}$$

with $$\phi_p=\phi_0-2\pi\frac{x_p}{\lambda}\ u$$

Once the malfunctioning phase-shifter is locked in a phase state $\phi_0$ and its symmetrical phase-shifter is locked in a supplementary phase state $\pi-\phi_0$ or $3\pi-\phi_0$ for example, it can be seen that the aiming error resulting from the blocking, in the supplementary fixed state $\phi_0-\pi$ or $3\pi-\phi_0$ for example, of the symmetrical phase-shifter is equal to and opposite to the error caused by the fixed state $\phi_0$ of the malfunctioning phase-shifter, this being the case whatever the aiming direction and the radiated frequency. Indeed, once the malfunctioning phase-shifter is locked in the chosen state $\phi_0$, it produces an error given by the relationship (5) and the symmetrical phase-shifter, once it is locked in the state $\pi-\phi_0$ or $3\pi-\phi_0$ for example, produces an error $\delta_{u\text{-}p}$ given by the following relationship:

$$\delta_{u_{-p}}=-\frac{\lambda}{2\pi}\ \frac{A_{-p}x_{-p}\sin\phi_{-p}}{\sum_{n=-N/2}^{N/2}A_n X_n} \tag{6}$$

with $$\phi_{-p}=(\pi-\phi_0)-2\pi\frac{x_{-p}}{\lambda}\ u$$

or

-continued $$\phi_{-p}=(3\pi-\phi_0)-2\pi\frac{x_{-p}}{\lambda}\ u$$

From $x_{-p}=-x_p$ it follows that $$\phi_{-p}=\pi-\phi_0+2\pi\frac{x_p}{\lambda}\ u=\pi-\phi_p$$

or $$\phi_{-p}=3\pi-\phi_0+2\pi\frac{x_p}{\lambda}\ u=3\pi-\phi_p,$$

which gives, in both cases sin e $\phi_{-p}$=sin e $\phi_p$.

Since $A_{-p}=A_p$ and $x_{-p}=-x_p$, it follows that:

$A_{-p}=A_p\sin\phi_{-p}=A_p x_p\sin\phi_p$ and therefore that $\delta u_{-p}=-\delta u_p$ Consequently, the addition of the errors $\delta u_{-p}$ and $\delta_p$ produce a total error equal to zero, whatever may be the direction cosine u, hence the aiming of the beam, and whatever may be the wavelength $\lambda$ of the radiated signal.

In the case of the second possible embodiment mentioned above, where the phase-shifter is not locked in a fixed phase state but where its available phase states continued to be exploited, the command given at a given point in time may be the same as in the absence of a malfunction or else may take account of the type of malfunction detected so that, for example, it achieves as close an approximation as possible to the desired state by means of the phase states that are still available. In both cases, the phase $\phi_A$ that is actually obtained is a function of the command given and of the malfunction affecting the phase-shifter. The symmetrical phase-shifter is then not locked in a fixed state but constantly receives a command placing it in a phase $\phi_B$ that is supplementary to the phase $\phi_A$ achieved on the malfunctioning phase-shifter, namely $\phi_B=\pi-\phi_A$ or $3\pi-\phi_A$ for example.

The device according to the invention may be used, for example, for antennas, in an MLS landing system of the type wherein each of the two antennas of the system, the azimuth antenna and the elevation antenna, radiates a fan-type beam, namely a beam that is angularly narrow in one dimension and wide in the other. The spatial scanning of these beams is done by electronic scanning at a speed of 50 microseconds per degree for example. The device according to the invention can be used to obtain an MLS system that is improved with regard to the aiming precision, hence with regard to the aircraft guiding precision, because the aiming errors of the fanning-beam antennas caused by the malfunctions on the electronically controlled phase-shifters are compensated for by the device according to the invention.

An azimuth electronic scanning antenna of the an MLS system, is for example, formed by a plane network of radiating waveguides that are evenly spaced out, supplied through a power distribution system and connected to the output of a transmitter. The antenna has, for example, N radiating waveguides, N being an even number. These waveguides are, for example, numbered from 1 to N/2 for the right-hand part and from −1 to −N/2 for the left-hand part. The waveguide numbered n and −n are symmetrical with respect to the plane of symmetry of the antenna and the power distribution is also symmetrical.

With each radiating waveguide, there is associated a four-bit phase-shifter for example. There are therefore N phase-shifters each capable of assuming $2^4=16$ phase states of 0° to 337.5° in steps of 22.5° . These phase-shifters, for example, comprise a succession of four phase-shifter cells, respectively giving phase-shifts of 180°, 90°, 45° and 22.5°. Each cell, for example, uses two diodes that are controlled either in the on state or in the off state. Two diodes of one and the same cell receive at all times (except in the case of malfunctioning) identical control signals, i.e. they are both positioned at all times either in the on state, which corresponds to a first phase state or in the off state which corresponds to a second phase state of the cell.

The device according to the invention has, for example, means for the permanent monitoring of the state of the diodes. The state of the diodes is, for example, monitored through the control circuit by the value of the current in the control line and by the value of the voltage on the control line, each diode having a control line. Indeed, a diode that works normally consumes, in the on state, a significant current at low voltage and, in the off state, an almost-zero current at a voltage of several volts. The malfunctioning of a diode places it either in an open circuit, which is an infrequent case, or in a short circuit which is the general case. The control circuit monitors itself for example and sends the phase-shifter control system, called the aiming device, the overall state of the control circuit and of the phase-shifter. The device according to the invention, is, for example, located in this aiming device. It shares, for example, the physical circuits of this aiming device and has, for example, a software program installed as a complement to the software program of the aiming device.

Figure 2:
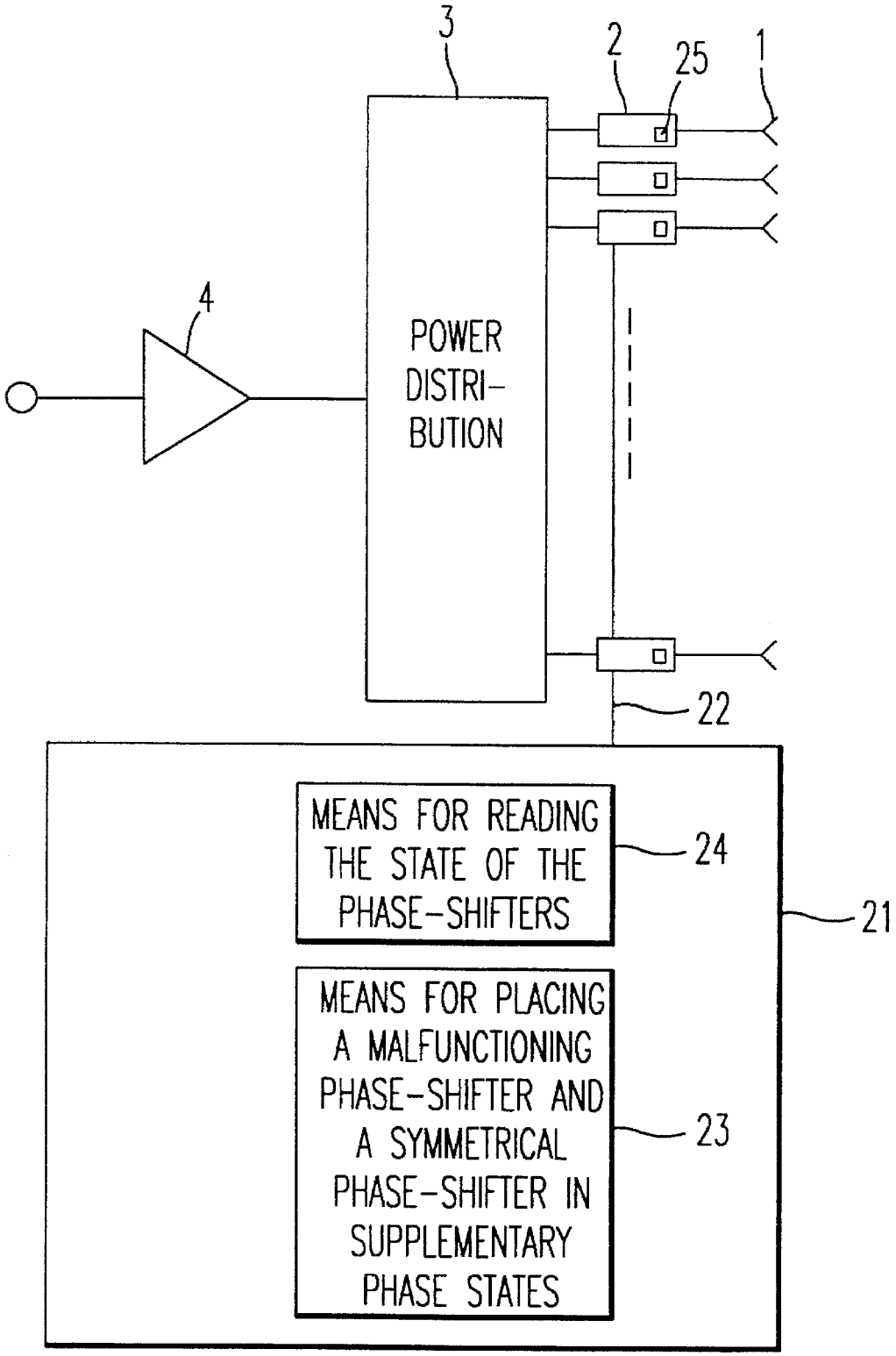
FIG. 2 shows a block diagram of the layout of means constituting the device according to the invention.

FIG. 2 gives an illustration, by way of an example and by means of a block diagram, of the layout of a device according to the invention in an aiming device 21. A bus 22 comprising all the control lines of the diodes of the phase-shifters 2 connects the phase-shifters 2 to the aiming device 21 by means of these lines. The phase-shifter 2 includes, for example, the device according to the invention which is at least formed by means 23 for placing a phase-shifter in a state of malfunctioning and its symmetrical phase-shifter in supplementary phase states. It is furthermore constituted, for example, by means 24 for reading the state of the phase-shifter. These states are obtained, for example, in the manner referred to above by the comparison of the currents and the voltages of the diodes of the phase-shifters with the order of positioning conveyed by the control lines of the bus 22. The other functions of the aiming device 21, known to those skilled in the art, are not shown. The phase-shifters 2 are, for example, fitted out with means 25 for establishing their state, these means acting, for example, by comparison of the voltages of the diodes with the control voltages conveyed by the bus 22.

To process the case where a detected malfunction relates to only one diode of a phase cell comprising two diodes used in a phase-shifter, a processing of the other diode of the cell may be done in such a way that the malfunctioning of a single diode prompts only blocking in one of the normal states of the phase cell of which the diode is a part. The second diode of the cell may, for example, be used in the same state of microwave impedance as the malfunctioning diode by means for controlling the state of the diodes of the device according to the invention. Thus, for example, if the malfunctioning diode is in an open circuit, the second diode is placed in the off state. The two diodes then have the same impedance state, namely an open circuit state, for a high frequency signal only if they are both in operating condition and locked. As a result, any malfunctioning of only one diode results in the phase cell of which it is a part being locked in one of its two normal states.

Figure 3:
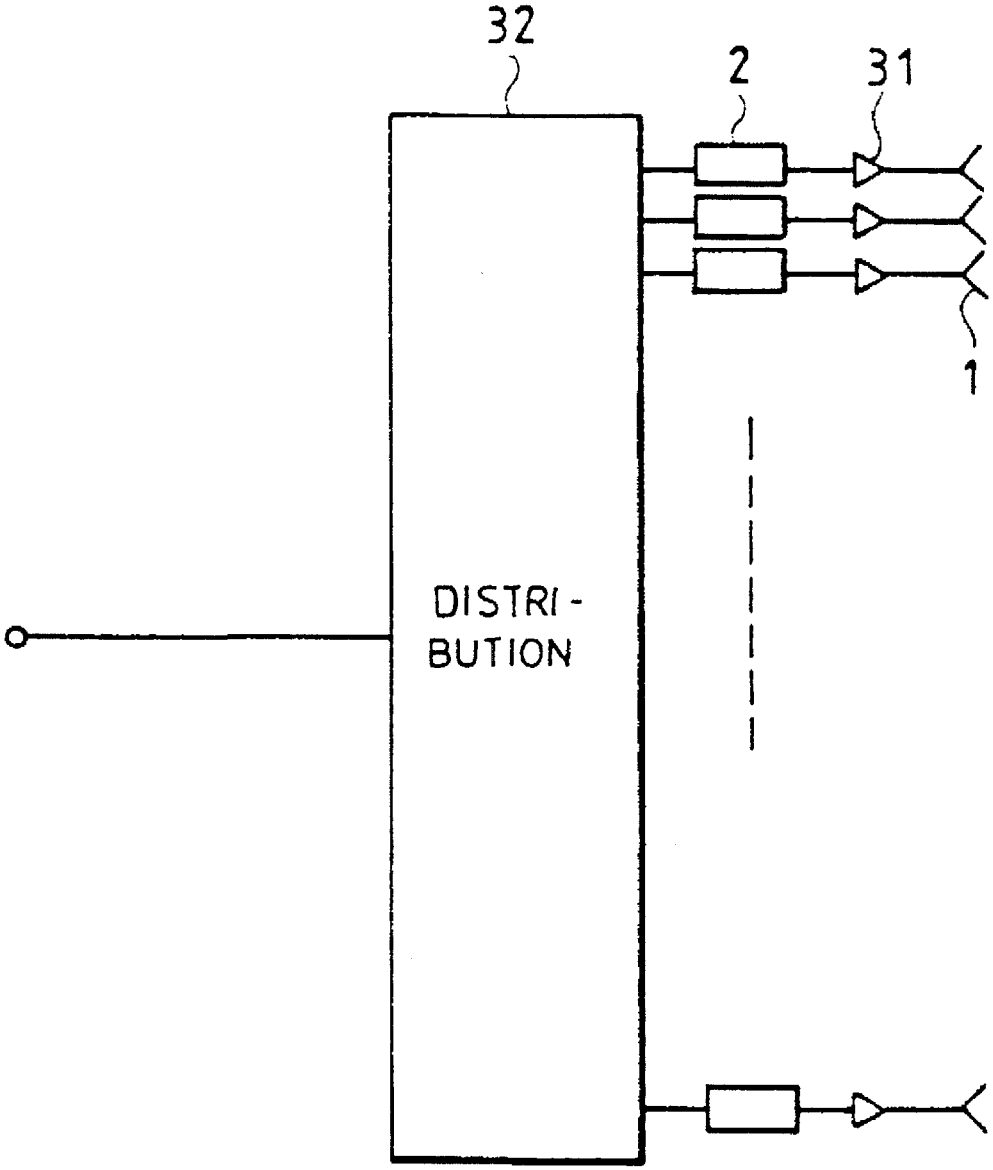
FIG. 3 exemplifies an active antenna capable of using a device according to the invention.

The device according to the invention can be applied not only to a passive antenna supplied through a power distribution system and diode phase-shifters from a centralized transmitter but also to an active antenna incorporating the transmission function as illustrated in FIG. 3. In this case, a plurality of amplifiers 31 connected to the outputs of a low-level distribution system 32 supplies the different radiating elementary sources. The phase-shifters 2 are, this time for example, placed upline with respect to the amplifiers 31 and may possibly be incorporated into it, the entire system being, for example, possibly made in the form of an integrated circuit.

By cancelling the aiming error related to the malfunctioning of one or more phase-shifters or their control, the device according to the invention frees the designing of the antennas from the constraints resulting from the effect of the malfunctions on the aiming precision. It therefore makes it possible, by the elimination of a major cause of imprecision, to have a simpler design that is therefore less costly. It can furthermore be applied to all types of electronically controlled phase-shifters irrespectively of the technology used. It can be applied notably to ferrite phase-shifters, diode phase-shifters or MMIC (microwave monolithic integrated circuits) phase-shifters. Furthermore, it is not necessary to incorporate means into a phase-shifter to prevent it from radiating when it is malfunctioning. This is a major advantage for the phase-shifter is an element of which many units are used in an electronic scanning antenna. It therefore represents a major part of the cost of the antenna. Any increase in the complexity of the phase-shifter therefore has a negative effect on the cost of the antenna. The device according to the invention also has a flexibility of use due to the fact that there are a large number of solutions for choosing the phases $\phi_0$ and $\pi-\phi_0$, or $3\pi-\phi_0$ for example, which is equivalent, wherein the phase-shifter that is malfunctioning and its symmetrical phase-shifter are both locked. The result thereof is that should the symmetrical phase-shifters each have one bit locked in either of their two phase states, following a malfunction, there remains a sufficient number of degrees of freedom to make it possible, in almost all cases, to place both phase-shifters in phase states that fulfil the desired condition solely by means of action on the remaining bits.

The device according to the invention can also be transposed to the case of an antenna with beam-shaping by computation provided that this is a plane and symmetrical antenna and provided that the laws of computation of the beams are symmetrical in amplitude and phase. In this case, when one of the phase values $\phi_0$ to be used in the computation of a given radiation pattern is designated as being erroneous or even simply suspect, the invention consists, for this radiation pattern, in placing the phase value relating to the symmetrical radiating source in the supplementary phase state. Consequently, the aiming error related to the erroneous phase value $\phi_0$ is cancelled.

What is claimed is:

1. A device for the compensation of aiming errors caused by malfunctions of phase-shifters in a plane electronic scanning antenna having a power distribution that is symmetrical in amplitude and in phase, comprising:

phase-shifters that are located symmetrically with respect to the center of the antenna; and an aiming device, including, a means for positioning a malfunctioning phase-shifter and a symmetrically located phase-shifter in supplementary phase states.

2. A device according to claim 1, wherein the supplementary phase states, in which the malfunctioning phase-shifter and the symmetrically located phase-shifter are positioned, are fixed states that do not get modified as a function of an aiming of a beam of the antenna.

3. A device according to claim 1, wherein the phase states that have remained available on the malfunctioning phase-shifter continue to be exploited and the symmetrically located phase-shifter is positioned at all times in the phase state supplementary to that of the malfunctioning phase-shifter.

4. A device according to claim 1, wherein the phase shifters comprise phase cells having two diodes, and the aiming device further comprises a means to monitor a state of the diodes of the phase-shifters.

5. A device according to claim 4, wherein the aiming device further comprises a means to control the state of the diodes in such a way that, when one diode of a phase cell is malfunctioning, the other diode is placed in a same state of microwave impedance as the malfunctioning diode.

6. A device according to claim 1, wherein the electronic scanning antenna is active, and further comprises radiating elementary sources, and microwave amplifiers series-connected between the phase-shifters and the radiating elementary sources of the antenna.

7. A device according to claim 6, wherein the phase-shifter and the microwave amplifier are packaged onto a single integrated circuit.

8. A device according to claim 1, wherein the antenna belongs to an MLS type landing system.

9. A device according to claim 1, wherein the positioning means is integrated into the aiming device of the antenna.

10. In a device to provide compensation for aiming errors caused by erroneous values of phase coefficients of phase shifters located symmetrically with respect to the center of a planer antenna having beam formation that is symmetrical in amplitude and in phase, the improvement comprising:

a means for generating a phase coefficient of a phase-shifter located symmetrically to a malfunctioning phase-shifter having an erroneous phase coefficient so as to place the malfunctioning phase-shifter and the symmetrically located phase-shifter in supplementary phase states.

* * * * *